United States Patent [19]

Haugen, Jr.

[11] Patent Number: 5,016,752

[45] Date of Patent: May 21, 1991

[54] PICTURE AND NEGATIVE STORAGE CONTAINER

[76] Inventor: John M. Haugen, Jr., P.O. Box 1298, Everett, Wash. 98206

[21] Appl. No.: 513,875

[22] Filed: Apr. 24, 1990

[51] Int. Cl.[5] ..... B65D 85/00

[52] U.S. Cl. ..... 206/455; 40/156; 220/339

[58] Field of Search ..... 206/455, 449, 450; 40/490, 511, 513, 156; 220/339

[56] References Cited

U.S. PATENT DOCUMENTS

| | | | |
|---|---|---|---|
| 423,059 | 3/1890 | Lear | 206/455 |
| 4,011,940 | 3/1977 | Neal et al. | 220/339 X |
| 4,095,694 | 6/1978 | Jost | 206/455 |
| 4,102,452 | 7/1978 | Sato et al. | 220/339 X |
| 4,184,594 | 1/1980 | Hehn | 220/339 X |
| 4,310,091 | 1/1982 | Hara et al. | 206/455 |
| 4,691,456 | 9/1987 | Ackeret | 40/490 X |
| 4,774,779 | 10/1988 | Ackeret | 40/513 X |
| 4,886,166 | 12/1989 | Bankier et al. | 220/339 X |
| 4,932,529 | 6/1990 | Levine | 206/455 |

FOREIGN PATENT DOCUMENTS

| | | | |
|---|---|---|---|
| 2088337 | 6/1982 | United Kingdom | 206/455 |

*Primary Examiner*—Bryon P. Gehman

*Attorney, Agent, or Firm*—Fleit, Jacobson, Cohn, Price, Holman & Stern

[57] ABSTRACT

A picture container having the general shape and configuration of a book for easy storage on the end edge thereof on a shelf thereby making it easy to store, locate and retrieve pictures or photographs and their negatives. The picture container includes a generally rectangular, parallelepiped housing including a base and cover hingedly connected thereto by a narrow width sidewall with the base and cover including interengaging flanges when the cover is parallel to the base to form a container having the general shape and configuration of a book. The narrow sidewall forms a spine hingedly connected to the base and cover which allows the cover to open to a position completely spaced away from the base to make it easier to place the photographs and negatives in the container. The base of the container is provided with guides which are optionally positioned to receive and contain photographs of different standard sizes and the cover includes a structure for supporting the negatives in a secure and convenient position.

5 Claims, 1 Drawing Sheet

14
32
34
3
36
36
48
35
56
30
44
10
33
20
40
30
48
42
46
52
22
28
16
54
3
12
41
18

10
30
54
56
20
22

36
20
35
50
48
46
33
34
26
22
44
40
18
41
30
42
38
24
28

40'
40a
40b
26
32
20
44'
44a
24
35
43
18
34
43
52
28
22
44b
43
30

PICTURE AND NEGATIVE STORAGE CONTAINER

BACKGROUND OF THE INVENTION

Field of the Invention

The present invention generally relates to a storage system for photographs and negatives and more specifically to a picture container having the general shape and configuration of a book for easy storage on the end edge thereof on a shelf thereby making it easy to store, locate and retrieve pictures or photographs and their negatives. The picture container includes a generally rectangular, parallelepiped housing including a base and cover hingedly connected thereto by a narrow width sidewall with the base and cover including interengaging flanges when the cover is parallel to the base to form a container having the general shape and configuration of a book. The narrow sidewall forms a spine hingedly connected to the base and cover which allows the cover to open to a position completely spaced away from the base to make it easier to place the photographs and negatives in the container. The base of the container is provided with guides which are optionally positioned to receive and contain photographs of different standard sizes and the cover includes a structure for supporting the negatives in a secure and convenient position.

Information Disclosure Statement

When exposed film is developed and finished photographs or prints and the negatives are returned to a customer, they usually are placed in an envelope with the negatives being stored in a sleeve or paper holder. In many instances, after the photographs are observed by the customer, they are returned to the envelope and the envelope placed in a drawer or other storage container in a haphazard manner. In some instances, photographs are mounted in photo albums which eliminates any connection between the finished photographs and the negatives since the negatives usually are placed haphazardly in a drawer or other storage area. Thus, while various efforts have been made to store photographs, there is no storage system available for both photographs and negatives which can maintain the photographs securely in a stacked relationship with the negatives for that group of photographs being stored in the same container with the container being in the form of a book to enable it to be easily stored on bookshelves and the like.

SUMMARY OF THE INVENTION

An object of the present invention is to provide a picture container for conveniently, securely and neatly storing finished photographs and the negatives used in producing the photographs with the container having the overall shape and configuration of a book to facilitate its storage on bookshelves and the like.

Another object of the invention is to provide a picture container in accordance with the preceding object in which the base and cover include narrow flanges adjacent each end edge and adjacent the side edge remote from the spine of the book-like container with the flanges including interengaging means for alignment and friction latching engagement.

A further object of the invention is to provide a picture container in accordance with the preceding objects in which the base includes optional breakaway guide structures which engage corner edges of the photographs and the cover includes a structure engaging the end portions of sleeve negatives or negatives in paper holders.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
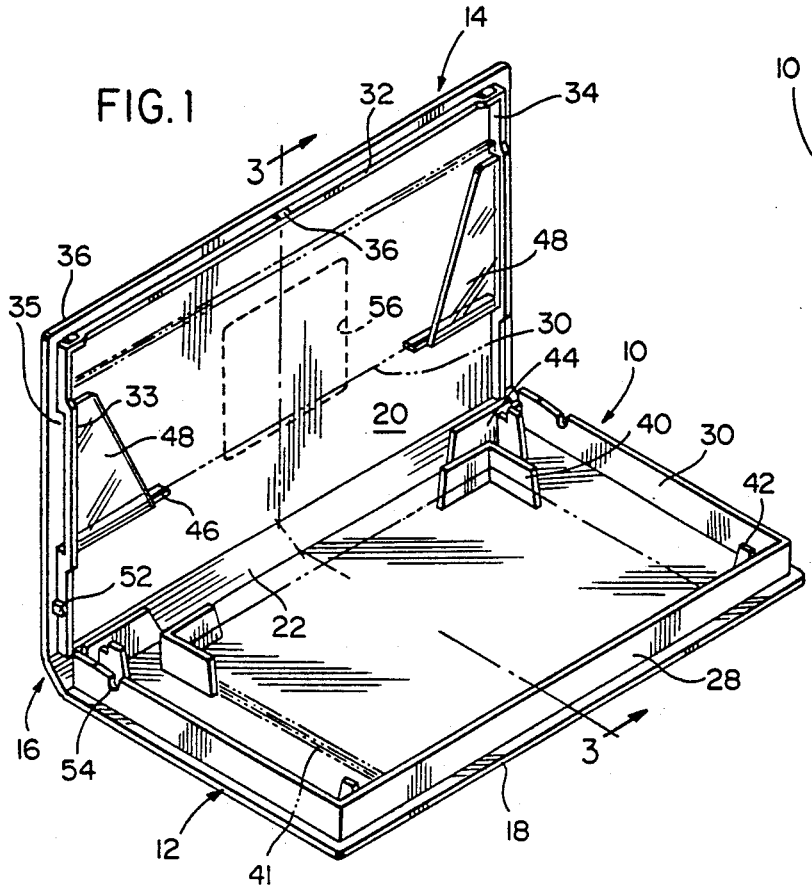
FIG. 1 is a perspective view of the picture container of the present invention when in open position illustrating the structural components.
Figure 2:
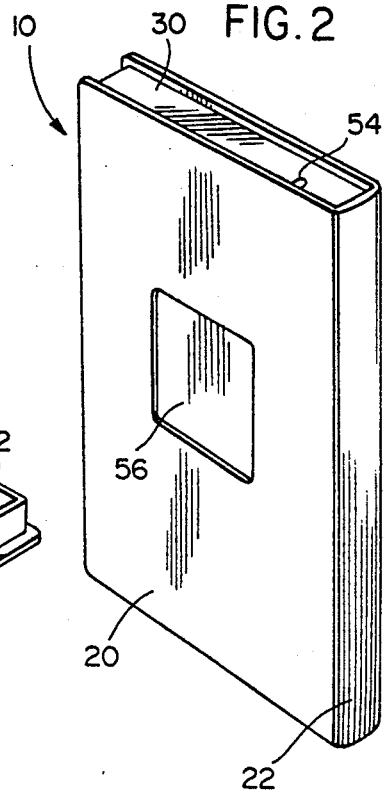
FIG. 2 is a perspective view of the picture container in its closed position.
Figure 3:
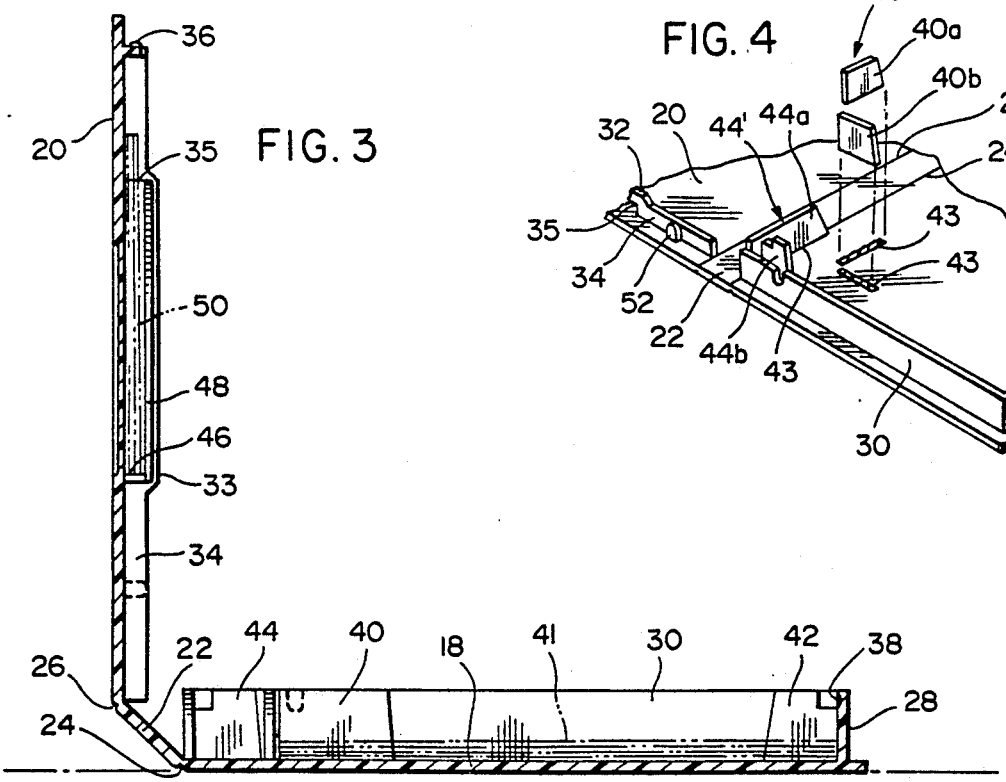
FIG. 3 is a transverse, sectional view taken substantially upon a plane passing along section line 3—3 on FIG. 1 illustrating further structural details of the invention.

Referring now specifically to the drawings, the picture container of the present invention is generally designated by reference numeral 10 and includes a base generally designated by the numeral 12 and a cover generally designated by the numeral 14 which are hingedly connected along one edge thereof by a narrow side wall generally designated by the numeral 16 to enable the cover 14 to move between an open and closed position with the open position generally being illustrated in FIG. 1. The overall shape and configuration of the container 10 is in the form of a rectangular parallelepiped housing which simulates a book in shape and size as illustrated in FIG. 2. This enables a plurality of picture containers to be stored on end edge on a bookshelf or the like.

The base 12 includes a substantially rectangular panel 18. The cover 14 includes a correspondingly shaped generally rigid panel 20. The spine 16 includes a narrow width panel 22 having the same length as the base and cover with the panel 22 being connected to the side edge of the base panel 18 by a hinge 24 and the panel 22 is connected to the cover panel 20 by a hinge 26. These components may be constructed of a plastic material and the hinges 24 and 26 may be a "living" hinge defined by a groove formed in the plastic material. This enables the spine structure to swing in a manner to displace the cover 14 laterally of the base 12 when the cover 14 is opened as illustrated in FIG. 1 thereby providing easy access to the upwardly facing surface of the base 12.

The base 12 includes an upwardly extending side flange 28 adjacent the side edge thereof remote from the spine 16 and also includes a pair of end flanges 30 which join with the ends of the flange 28 and are fixedly secured to the flange 28 and the base 12. The width of the flanges 28 and 30 is slightly less than the width of the spine 16. The cover 14 includes a narrow side edge flange 32 and narrow end edge flanges 34 which align with and engage the flanges on the base to form a peripheral closure for the picture container with the spine 16 and flanges on the base and cover cooperating to define a closed interior for the container with the projecting edges of the base and cover as well as the spine which extend beyond the flanges providing straight edges for effectively supporting the container on an end edge in a manner similar to the covers and spine of a book supporting a book on a supporting shelf.

Figure 4:
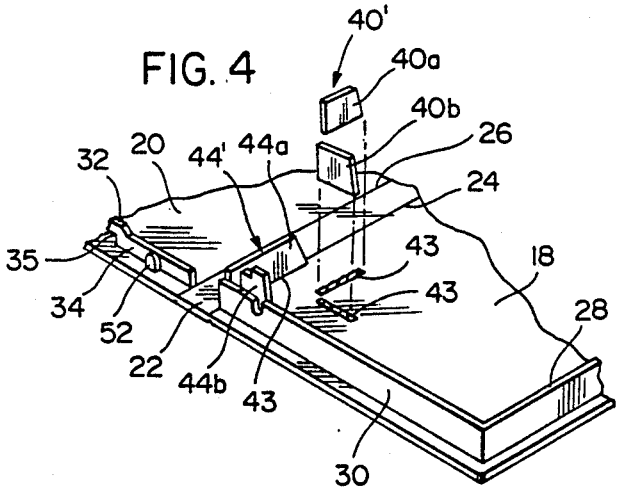
FIG. 4 is a fragmental perspective view of the breakaway corner engaging guides and adjacent portions of the container.

The flange 32 is provided with latching detents 36 for engagement with recesses 38 in the flange 28 to retain these components in latched telescopic relation. Positioned interiorly of the base panel 18 is a pair of spaced L-shaped corner guides 40 which are spaced from the flanges 30 and also spaced from the flange 28 in order to receive standard size photographic prints 41 such as $3\frac{1}{2}'' \times 5''$ prints between the corner guides 40 and the flange 28. End guide members 42 and L-shaped guide members 44 are positioned on the base to receive a larger standard size photographic print such as $4'' \times 6''$ when the guides 40 are omitted thus effectively containing a plurality of photographs in stacked relation. The guide members 44 include two components with one component forming a partial side edge flange on the base panel and the other component being perpendicular thereto. The guides 40 can be omitted when the panels are molded by employing a metal plate in the mold to close the cavity which forms the guide 40 thereby enabling the production of two forms of the invention, one with guides 40 and one without. FIG. 4 illustrates optional alternative guides 40' and guide member 44' for receiving and guiding the corner edges of a plurality of photographic prints. In this structure, each guide 40' and guide member 44' is constructed of two components 40*a*, 40*b* and 44*a*, 44*b* which are arranged in perpendicular relation to each other and to the base panel 18 and detachably connected to the base panel 18 along juncture areas 43. The adjacent ends of the components are spaced from each other to enable the components to be bent back and forth to break away the components from the base panel.

The cover 14 includes a pair of narrow width flanges or shelf member 46 and an angulated retainer panel 48 adjacent each end thereof with the retainer panel 48 being spaced from the cover panel 20 and having one edge secured to the flange 46 and the side edge thereof in perpendicular relation to the flange 46 being connected with the end edge flange 34 thus forming opposed laterally open sockets receiving the ends of a negative sleeve 50 positioned therein thereby supporting the negatives from which the photographic prints were made from the cover 14 thereby retaining the negatives in an associated relationship to the photographic prints. Each flange 34 includes an offset central portion 3 in alignment with the retainer panel 48 and the portion adjacent the cover panel 20 is provided with a slot 35 which enables a tongue on the molding apparatus to be inserted. Also, each flange 34 is provided with a laterally extending detent 52 adjacent to but in spaced relation to the spine 16 with the detent 52 being received in a notch 54 in the upper edge of the flange 30 thus aligning and guiding the flanges when they are telescoping and reinforcing the overlapping flanges 30 and 34.

The container as disclosed may be used by various photographic processors including professional as well as amateur photographic processors with the container forming a convenient container for the processed prints and negatives to facilitate return of these items to customers and to facilitate storage of the photographic prints and negatives in a secure, convenient and neat arrangement. The picture container enables the formation of a complete storage system for both the photographic prints and the negatives in the form of a book for easy storage on a shelf thereby making it easier to store and retrieve photographs. The specific construction of the container effectively supports a plurality of photographic prints and negatives in a housing which will support a relatively large weight thus enabling the containers to be stacked or stored on end on a bookshelf. The carrier pocket on the cover holds film negatives such as 35 mm. negatives in a sleeve or other negatives in paper holders. The guide members 40, 42 and 44 enable different sizes of photographic prints to be stored with the guides providing additional strength to the container. The interlocking detent or pin 52 and notch 54 properly align the cover with the base so the detents 36 and latches 38 will be properly aligned and will lock positively. The hinges 24 and 26 assure positive positioning of the cover and the base while allowing the cover to open wider to make placing the prints and negatives in the container easier. A removable insert 56 enables the name of the film processer or other information relating to the processers to be provided on the cover of the container.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A container for photographic prints and negatives comprising a base panel and a cover panel, means pivotally connecting the cover panel to the base panel along an edge portion of said panels to enable the cover panel to pivot between open and closed positions in relation to the base panel, said base panel and cover panel including edge flanges to define an enclosure when the cover panel is in closed position, means on the interior surface of the base panel positioning and supporting a plurality of photographic prints and means on the interior surface of the cover panel supporting negatives from which the photographic prints supported on the base panel were made, said container being of one-piece construction, said cover panel and base panel being generally of rectangular configuration, said means pivotally connecting the panels including a spine in the form of a narrow, elongated rectangular panel with the opposed, longer side edges of the spine being connected to the base panel and cover panel by hinges to space the base and cover panels apart with the edge flanges on the base and cover panels cooperating to form an enclosure when the cover panel is pivoted to a position parallel to the base panel, means interengaging the flanges on the base and cover panels to retain the base and cover panels in closed position with the edge flanges in telescopic side-by-side relation to reinforce the base and cover panels, said means supporting the photographic prints including a pair of L-shaped corner guide members mounted on the inner surface of the base panel in spaced relation to the edge flanges on the base panel engaging around the corners of photographic prints of one size on the base panel, and a second pair of L-shaped corner guides mounted on the base panel inwardly of the L-shaped guide members to engage the corners of smaller standard size photographic prints, each of said corner guides including a pair of components arranged in perpendicular relation to each other and the base panel, said pair of components being detachably connected to the base panel along juncture areas.

2. The container as defined in claim 1 wherein each opposite end edge flange on the base panel includes an inwardly extending notch extending inwardly from the outer edge of the flange, said notches being adjacent to but spaced from the spine, each opposed end edge flange on the cover panel including a projecting detent extending laterally from the opposed end edge flanges on the cover panel, said detents being adjacent to but spaced from the spine for registry with and reception in the notches when the cover panel is pivoted to a closed position to position the edge panels for telescopic engagement when the cover panel is closed.

3. A container for photographic prints and negatives comprising a base panel and a cover panel, means pivotally connecting the cover panel to the base panel along an edge portion of said panels to enable the cover panel to pivot between open and closed positions in relation to the base panel, said base panel and cover panel including edge flanges to define an enclosure when the cover panel is in closed position, means on the interior surface of the base panel positioning and supporting a plurality of photographic prints and means on the interior surface of the cover panel supporting negatives from which the photographic prints supported on the base panel were made, said container being of one-piece construction, said cover panel and base panel being generally of rectangular configuration, said means pivotally connecting the panels including a spine in the form of a narrow, elongated rectangular panel with the opposed, longer side edges of the spine being connected to the base panel and cover panel by hinges to space the base and cover apart with the edge flanges on the base and cover panels cooperating to form an enclosure when the cover panel is pivoted to a positioned parallel to the base panel, means interengaging the flanges on the base and cover panels to retain the base and cover panels in closed position with the edge flanges in telescopic side-by-side relation to reinforce the base and cover panels, said means supporting the negatives on the cover panel including a pair of laterally extending shelf members perpendicular to the cover panel and extending inwardly from opposed and edge flanges on the cover panel, and a pair of retainers spaced from the inner surface of the cover panel to receive the ends of negatives, each retainer having one edge connected to the outer edge of a shelf member, a second edge connected to an end edge flange on the cover panel and an inner inclined edge to form opposed pockets to receive 4. The container as defined in claim 3 wherein each opposite end flange on the base panel includes an inwardly extending notch extending inwardly from the outer edge of the flange, said notches being adjacent to but spaced from the spine, each opposed end edge flange on the cover panel including a projecting detent extending laterally from the opposed end edge flanges on the cover panel, said detents being adjacent to but spaced from the spine for registry with and reception in the notches when the cover panel is pivoted to a closed position to position the edge panels for telescopic engagement when the cover panel is closed.

5. A container for photographic prints and negatives comprising a base panel and a cover panel, means pivotally connecting the cover panel to the base panel along an edge portion of said panels to enable the cover panel to pivot between open and closed positions in relation to the base panel, said base panel and cover panel including edge flanges to define an enclosure when the cover panel is in closed position, means on the interior surface of the base panel positioning and supporting a plurality of photographic prints and means on the interior surface of the cover panel supporting negatives from which the photographic prints supported on the base panel were made, said container being on one-piece construction, said cover panel and base panel being generally of rectangular configuration, said means pivotally connecting the panels including a spine in the form of a narrow, elongated rectangular panel with the opposed, longer side edges of the spine being connected to the base panel and cover panel by hinges to space the base and cover panels apart with the edge flanges on the base and cover panels cooperating to form an enclosure when the cover panel is pivoted to a position parallel to the base panel, means interengaging the flanges on the base and cover panels to retain the base and cover panels in closed position with the edge flanges in telescopic side-by-side relation to reinforce the base and cover panels, said means supporting the photographic prints including a pair of L-shaped corner guide members mounted on the inner surface of the base panel in spaced relation to the edge flanges on the base panel engaging around the corners of photographic prints of one size on the base panel, said means supporting negatives on the cover panel including a pair of laterally extending shelf members perpendicular to the cover panel and extending inwardly from opposed end edge flanges on the cover panel, and a pair of retainers spaced from the inner surface of the cover panel to receive the ends of negatives, each retainer having one edge connected to the outer edge of a shelf member, a second edge connected to an end edge flange on the cover panel and an inner inclined edge to form opposed pockets to receive negatives.

* * * * *